US009126121B1

(12) United States Patent
Milam et al.

(10) Patent No.: US 9,126,121 B1
(45) Date of Patent: Sep. 8, 2015

(54) THREE-AXIS RIDE CONTROLLED BY SMART-TABLET APP

(71) Applicants: M. Harris Milam, Houston, TX (US); George W. Batten, Jr., Houston, TX (US); Robert L. Terry, Houston, TX (US)

(72) Inventors: M. Harris Milam, Houston, TX (US); George W. Batten, Jr., Houston, TX (US); Robert L. Terry, Houston, TX (US)

( * ) Notice: Subject to any disclaimer, the term of this patent is extended or adjusted under 35 U.S.C. 154(b) by 0 days.

(21) Appl. No.: 14/633,429

(22) Filed: Feb. 27, 2015

Related U.S. Application Data

(60) Provisional application No. 61/946,685, filed on Feb. 28, 2014.

(51) Int. Cl.
*A63G 31/16* (2006.01)
*A63F 13/00* (2014.01)

(52) U.S. Cl.
CPC ..... *A63G 31/16* (2013.01)

(58) Field of Classification Search
CPC ..... A63G 1/00; A63G 1/10; A63G 1/24; A63G 1/30; A63G 1/48; A63G 31/00; A63G 31/16; A47F 1/00; A47F 1/12; A63F 13/00; A63F 13/12; A63F 13/90
USPC ..... 472/2, 59, 60, 61, 130; 434/29, 55
See application file for complete search history.

(56) References Cited

U.S. PATENT DOCUMENTS

| | | | | |
|---|---|---|---|---|
| 3,135,057 | A * | 6/1964 | Nelson et al. | 434/34 |
| 4,856,771 | A * | 8/1989 | Nelson et al. | 472/2 |
| 4,995,603 | A * | 2/1991 | Reed | 472/60 |
| 5,551,920 | A * | 9/1996 | Ogden et al. | 472/59 |
| 5,911,634 | A * | 6/1999 | Nidata et al. | 472/59 |

* cited by examiner

*Primary Examiner* — Kien Nguyen

(57) ABSTRACT

This motion simulator uses a spherical shape driven by controlled wheels to produce any rotational motion within certain limits. The range of pitch and roll motions can be at least −15 to +15 degrees; yaw is unlimited. There are no moving electrical connections such as slip rings. The physical system can be produced inexpensively. Control and simulation display use a smart phone or computer tablet, which, for example, could be one already owned by a family using the simulator.

10 Claims, 6 Drawing Sheets

THREE-AXIS RIDE CONTROLLED BY SMART-TABLET APP

CROSS-REFERENCE TO RELATED APPLICATIONS

This patent claims the benefit of U.S. provisional patent No. 61/946,685 filed on Feb. 28, 2014, which is herein incorporated by reference.

U.S. Pat. Nos. 5,490,784 and 6,629,896 describe large simulators with spherical moving platforms, supported by drive wheels which move the sphere by friction. These inventions are not suitable for home use.

In contrast, the present invention is small enough to be used in homes. Since it uses a computer tablet as the main control device, a family can purchase a basic physical unit, then use an already-owned computer tablet for the control. Thus the physical units can be sold inexpensively.

U.S. PATENT DOCUMENTS

| | | | | |
|---|---|---|---|---|
| 5,490,784 | February 1996 | Carmein | Virtual reality system with enhanced sensory apparatus | 434/55 |
| 6,629,896 | October 2003 | Jones | Nimble virtual reality capsule using rotatable drive assembly | 472/60 |
| 8,939,455 | January 2015 | Terry | Ride-on vehicle and game seat for infants and young children | 180/19.1 |
| 14/096,986 | December 2014 | Batten | Children's ride-on vehicle with computer-tablet display and child supervision | |
| 62/117,491 | February 2015 | Batten | Self-Pivoting Drive for Spherical-Form Motion Simulators | |

OTHER PUBLICATIONS www.simcraft.com Simcraft web page

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISC APPENDIX

Not applicable

BACKGROUND OF THE INVENTION

1. Field of the Invention

The purpose of this invention is providing a low-cost motion simulator to be used in homes and other venues. The invention can be adapted for children or adults.

The invention has a seat which moves in response to signals from a smart phone or smart tablet, hereinafter referred to as "computer tablet." The nature of the motion is determined by application-specific software (an "app") in the computer tablet. The computer tablet's display is used to display motion-related images. The seat can rotate about any axis. Pitch and roll are limited, but the range of each is sufficient for many simulations. Yaw is unlimited.

2. the Prior Art

Many motion simulators have been developed. A well-known early one was the Link Trainer, which had an analog control system and a mechanical arrangement based of pneumatic devices. There are many modern motion simulators using digital computers for control. Some are large and very expensive, so they are used only by such persons as professional aircraft pilots.

One marketed by Simcraft is small enough for nonprofessional use. It has a seat mounted on gimbals, so any rotation is possible. The control system is a conventional digital computer with application-specific software. There seem to be no patents for this device.

BRIEF SUMMARY OF THE INVENTION

This invention relates generally to game seats with motion simulation, and motion simulators in general. Related information appears in the U.S. Pat. No. 8,939,455 and U.S. patent application Ser. No. 14/096,986, which describe the mechanical, electrical, control, and communication aspects of a base vehicle. The present invention is a stationary unit with a moving platform for a human rider, but it does use some electrical, control, and communication features that are similar to ones in those patents.

The invention comprises a base unit and a moving platform. See FIG. 1. The moving platform has an exterior shell which is supported by a freely moving ball and two assemblies with drive wheels for rotating the platform. FIG. 3 shows the baseplate with the drive wheels and ball. The axes of the drive wheels rotate so they can produce any rotation of the moving platform. Pitch and roll are limited: typically, pitch and roll angles can be at least −15 to +15 degrees, which is enough to be useful for many simulations. Yaw rotation is unlimited.

The invention includes a fixed-position retainer plate 7 between the exterior and interior shells. See FIG. 2. That plate prevents tipping, which might happen, for example, when a rider climbs on board. The retainer plate can be made so that it does not touch any part of the moving platform under normal conditions; this avoids certain frictional losses that would otherwise occur with any rotation.

Electrical signals from an electronics module (not shown in the figures) mounted on the base unit power the drive wheels and determine the direction and rotational speed of the wheels. The electronics module carries out some basic computations for control, but the motion plan is determined by a computer tablet in the moving platform. The computer tablet is mounted on a bracket that holds it in view of the human rider, so the computer tablet display becomes part of the simulation. The bracket is moved out of the way when a different display (e.g., a large, wall-mounted display) is used.

Control signals, mostly descriptions of required rotations, are sent from the computer tablet to the electronics module in the base unit through a bidirectional wireless link. That link also carries moving-platform position information from the electronics module to the computer tablet. Thus, there are no wires between the base unit and the moving platform; the invention does not need slip rings or other moving electrical connections.

The computer tablet touch screen can be used as a control for interactive simulations. Alter-natively, other controls—joystick, steering wheel, switches, etc.—can be used if they are linked to the computer tablet. Wireless links are preferred. One advantage of this arrangement is that controls can be switched easily, so each type of simulation can have a simulation-specific set of controls.

Under some conditions it might be useful to mount the invention on a steerable base unit with powered wheels, and to provide controls so the rider could drive the unit from place to place. It that case it might be appropriate to apply the concepts taught in U.S. Pat. No. 8,939,455 and U.S. patent application Ser. No. 14/096,986.

Figure 1:
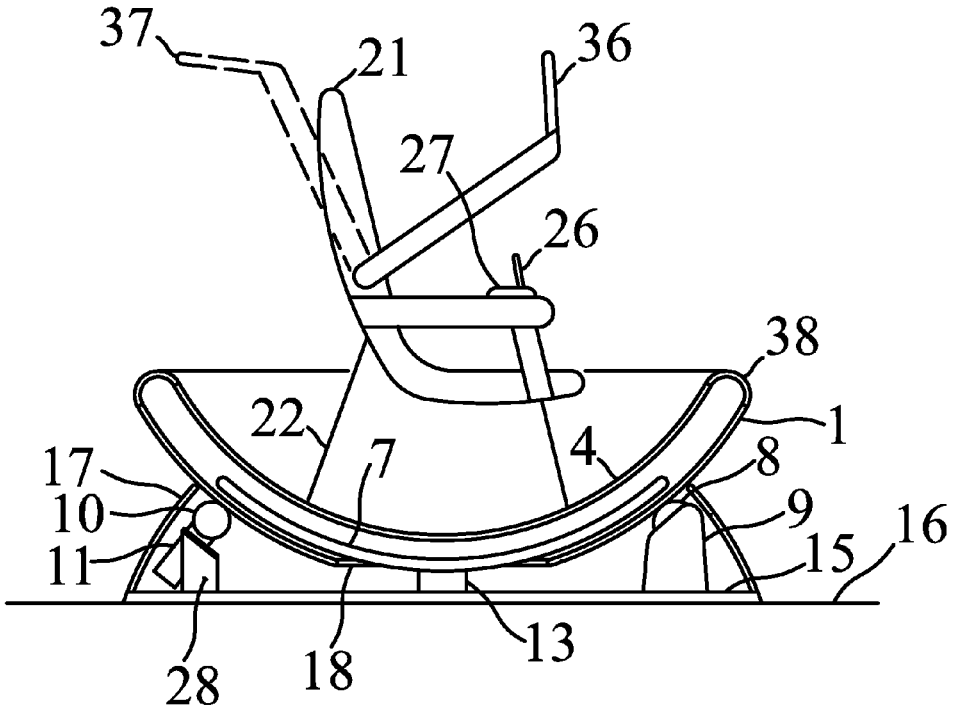
FIG. 1 shows a partial section of the ride as viewed from one side.

1 Outer shell.
4 Inner shell.
7 Retainer plate.
8 Ball supporting outer shell 1.
9 Mount for the outer shell support ball 8.
10 Wheels driving movements of outer shell 1.
11 Mount and drive motors for wheels 10.
13 Mount for the retainer plate 7.
15 Base plate as seen from above.
16 Floor surface.
17 Shroud.
18 Edge of clearance opening in outer shell 1.
21 Seat.
22 Seat mounting bracket.
26 Joy stick (or other control device).
27 Armrest-mounted controls.
28 Support for the mount and drive motors 11.
29 Caster supporting outer shell 1.
30 Mount for the outer shell support caster 29.
31 Position sensor (optical or magnetic).
32 Mount for the position sensor 31.
36 Bracket for the computer tablet.
37 Alternate position of bracket 36.
38 Shell closure and support for inner shell 4.
40 Great circle on the spherical surface with center C and passing through the wheel reference points $P_1$ and $P_2$.
41 Arc-with-arrow showing rotation corresponding to the vector R.
50 Pivoting frame supporting the drive wheels 10.
51 Fixed frame for the motors and angle sensor.
72 Mounting plate.
79 Surface of the outer shell.

DETAILED DESCRIPTION OF THE INVENTION

A fundamental mechanical element of this invention is the spherical surface of outer shell 1, the motion of which is driven by the wheels of two assemblies. Each such assembly comprises a single wheel, or a pair of wheels, frictionally contacting the spherical surface; associated motors; and a mounting arrangement. The mounting arrangement provides for the wheel axis direction to be changed, thereby changing the direction of motion of the sphere. Outer shell 1 supports the entire moving platform.

Figure 3:
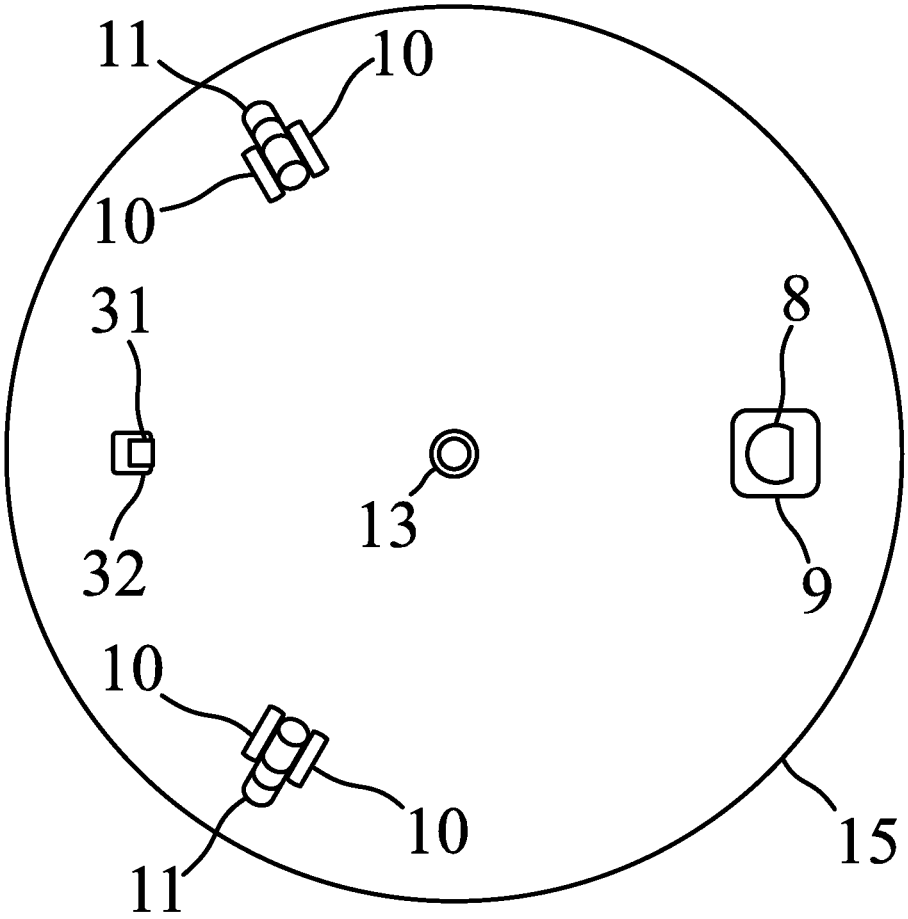
FIG. 3 is the base plate 15 as viewed from the top.

FIG. 1 is a partial sectional view with some parts rotated into the plane of the view as is commonly done in good drafting practice. It shows outer shell 1 resting on freely-rotating ball 8 in its mount 9, and one of the drive wheels 10 on its mechanism and mount 11. FIG. 3 shows the ball and drive wheels arranged in a triangular pattern on the base plate 15. Drive wheel 10 and its mechanism 11 have controlled bidirectional motors and gears that drive the rotation of each wheel about its axis, and set the direction of the wheel axis, hence the direction of wheel action. U.S. Pat. No. 5,490,764 shows three arrangements for mechanisms of this type (in that patent's FIGS. 4, 5, and 6).

Figure 4:
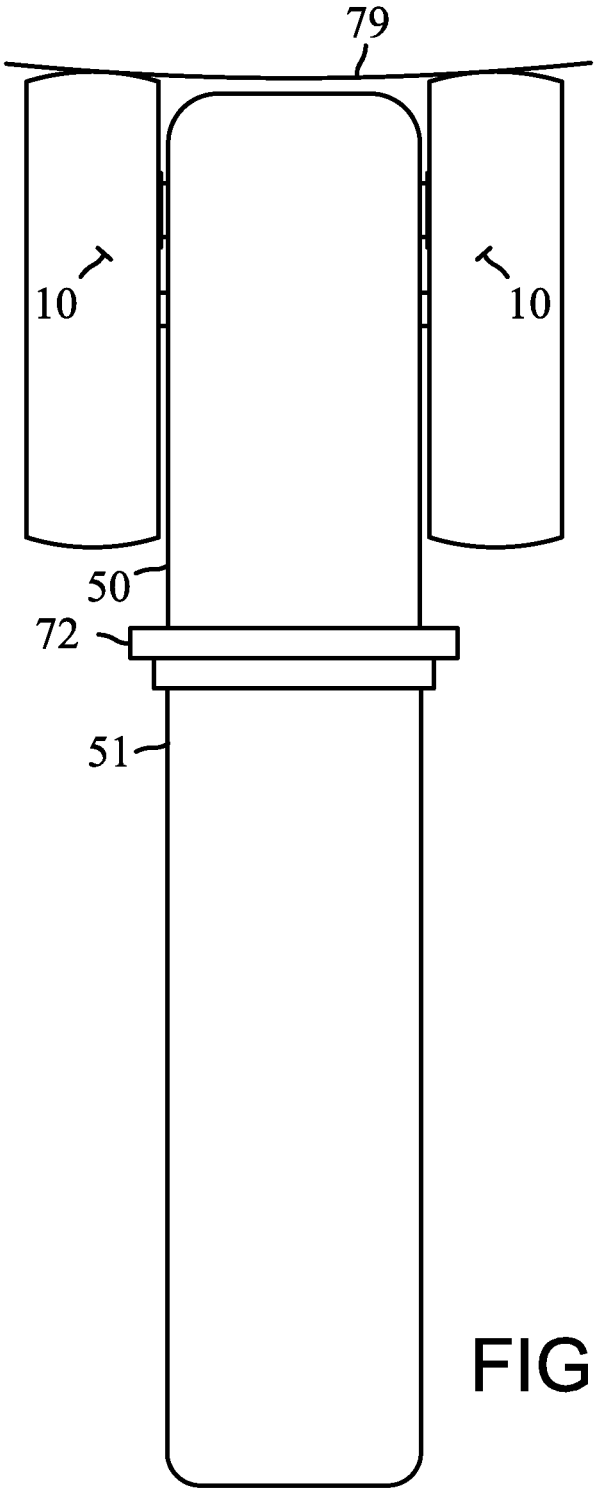
FIG. 4 is a view of a drive wheel mechanism.

FIG. 4 shows another arrangement for the wheel mechanism. In that figure, wheels 10 are mounted on freely pivoting frame 50. The axles of the wheels have a common centerline. Motors driving the wheels are in fixed frame 51. Mounting plate 72 supports the mechanism. The wheels frictionally contact outer surface 79 of outer shell 1 and drive the shell's motion. The direction of wheel action is determined by controlled differential rotation of the two wheels 10, which causes freely pivoting frame 50 to rotate. This mechanism is described in more detail in U.S. patent application 62/117,491.

One unique feature of this invention is retainer plate 7, which is rigidly mounted on base plate 15 using mount 13. The retainer plate prevents tipping of outer shell 1, hence that of the moving platform. Mount 13 passes through a clearance opening, shown as edge 18, in outer shell 1. While the retainer plate and its mount limit the range of motion of the outer shell, a preferred arrangement will allow sufficient motion for the intended applications. For the configuration shown in FIG. 1, roll and pitch can range at least from −15 to +15 degrees. Yaw is unlimited.

Shroud 17 encloses the movement mechanism. Base plate 15 rests on floor surface 16.

In the moving platform, inner shell 4, which separates the rider space from retainer plate 7, is attached to outer shell 1 by shell closure 38. FIG. 1 shows inner shell 4 as a spherical section, but the shape is not important as long as it provides clearance for retainer plate 7, and structural support for seat 21 and the rider. Seat 21, which is mounted on seat mounting bracket 22, has a movable bracket 36 to support the computer tablet within view of the rider. FIG. 1 shows the alternate position 37 of bracket 36 when it has been moved to an out-of-the-way position. Various rider-operated controls 27, including, for example, a joystick 26, are be mounted on the seat. The computer tablet is bidirectionally linked, preferably by wireless connections, to controls that are not part of the computer tablet and to an electronics module (not shown in the figures) in the base unit. That electronics module produces the electrical signals powering the motors of the drive-wheel assemblies.

Mathematics of the Rotation

It is useful to have some mathematical notations for describing control of the drive wheels. To that end, identify each wheel assembly with a number 1 or 2, wheel assembly 1 being the first one encountered in moving from the support ball in a counterclockwise direction around the center of base plate 15 as seen from above, and wheel assembly 2 being the other one. In the following, k will denote either wheel number, and "sphere" will mean the sphere of the exterior surface of outer shell 1.

Let $u_k$ be the unit vector pointing from the center C of the sphere toward wheel assembly k. More specifically, $u_k$ points toward a point $P_k$ called "wheel reference point k" defined as follows: if wheel assembly k has a single wheel, then $P_k$ is the point at which the wheel contacts the spherical surface; if wheel assembly k has a pair of wheels, $P_k$ is midway between the points at which the two wheels contact the spherical surface. See FIG. 5.

The two vectors $u_1$ and $u_2$ and the center C determine a plane P. Let w denote the unit vector orthogonal to P and pointing in the direction of motion of a right-handed screw rotating about C from $P_1$ to $P_2$. In conventional vector notation, $w=(u_1\times u_2)/|u_1\times u_2|$, where × is the usual vector cross product, and the denominator is the length of $u_1\times u_2$. Let $v_k=w\times u_k$. Then $u_k$, $v_k$, and w are unit basis vectors for a right-handed coordinate system.

Figure 5:
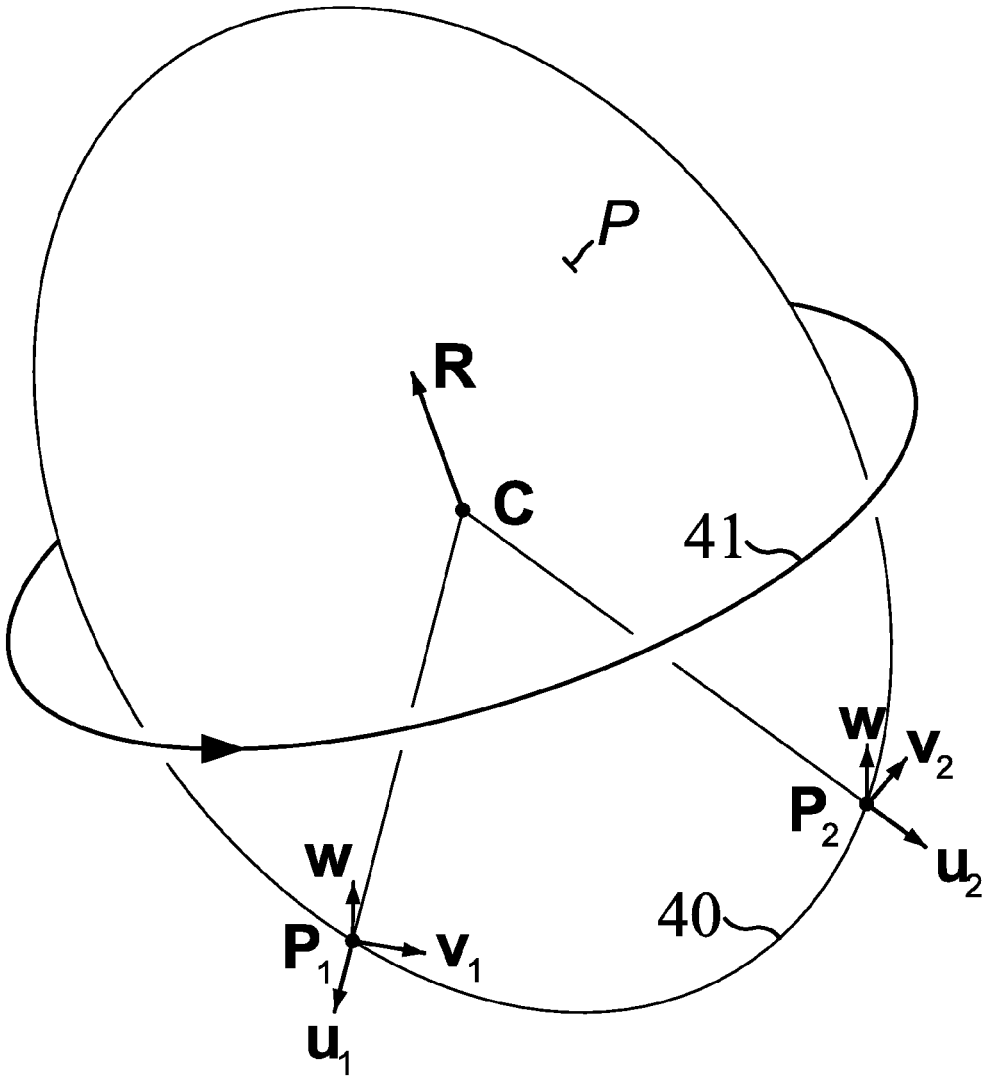
FIG. 5 is a diagram showing various points, lines, and vectors, including a rotation vector R.

FIG. 5 shows the plane P and the sphere's great circle 40 intersection with P. The great circle has its center at C, and it passes through wheel reference points $P_1$ and $P_2$. The figure also shows a rotation vector R and the arc-with-arrow 41 showing the rotation associated with R. Coordinate vectors $u_1$, $u_2$, $v_1$, $v_2$, and w (the latter in two places) are shown moved to the corresponding wheel reference points $P_1$ and $P_2$.

Let $R_1$, and $R_2$ be the rotation vectors associated with sphere rotation due to the drive wheels at $P_1$, and $P_2$, respectively. Since each of these is orthogonal to the corresponding $u_k$, these can be expressed as follows:

$$R_1=\beta_1 v_1+\gamma_1 w, \text{ and}$$

$$R_2=\beta_2 v_2+\gamma_2 w,$$

where $\beta_1$, $\gamma_1$, $\beta_2$, and $\gamma_2$ are numbers. The vectors $\gamma_1$ w and $\gamma_2$ w represent rotations in the plane P. In order that there be no conflict (i.e., jamming) between drive wheels at $P_1$ and $P_2$, these must be equal, so $$R_1=\beta_1 v_1+\gamma w, \text{ and}$$

$$R_2=\beta_2 v_2+\gamma w, \tag{1}$$

where $\gamma$ is the common value of $\gamma_1$ and $\gamma_2$.

The vector $\beta_1$ $v_1$ represents a rotation orthogonal to the plane P. That rotation must have $P_2$ as a fixed point because drive-wheel friction will block non-zero motion there (unless the drive-wheel motion at that point is identical to that caused by the rotation $\beta_1$ $v_1$). The only way that this can be guaranteed is for the line through C and $P_2$, the axis of this rotation, to be parallel to $v_1$. The same argument can be applied to $\beta_2$ $v_2$, mutatis mutandis, of course.

Thus, $P_1$ and $P_2$ must be positioned so that $u_1$ and $u_2$ are orthogonal. This is the same as requiring that the lines from C to each of $P_1$ and $P_2$ be orthogonal, which is assumed henceforth.

The overall rotation, represented by the vector R, is a combination of $R_1$ and $R_2$. It is the sum of the orthogonal in-plane components and the out-of-plane component:

$$R=\beta_1 v_1+\beta_2 v_2+\gamma w. \tag{2}$$

The first step in controlling sphere motion is determining $\beta_1$, $\beta_2$, and $\gamma$ from a given R. Then those values are used to set the direction and speed of the drive wheels. Since $v_1$, $v_2$, and w are mutually orthogonal, this is just a matter of computing vector dot products:

$$\beta_1=v_1\cdot R,$$

$$\beta_2=v_2\cdot R, \text{ and}$$

$$\gamma=w\cdot R. \tag{3}$$

Drive wheel rotations $R_{w1}$ and $R_{w2}$ at $P_1$ and $R_2$, respectively, are $$R_{w1}=-\rho(\beta_1 v_1+\gamma w), \text{ and}$$

$$R_{w2}=-\rho(\beta_2 v_2+\gamma w), \tag{4}$$

where $\rho$ is the ratio of sphere radius to drive wheel radius, and the minus sign arises from the fact that wheel rotation is opposite to the corresponding sphere rotation.

Control

The timed sequence of rotations generated by the computer tablet are sent through the wireless link to the electronics module in the base unit. That module receives the required rotations, and converts them to signals controlling the motors of the drive-wheel assemblies.

The electronics module also determines the position of the moving unit, for example using an optical or magnetic sensor and corresponding marks on or magnets in the outer shell, and sends the position information back to the computer tablet in the moving unit. Methods for doing this will be apparent to persons knowledgeable of the relevant art.

Figure 6:
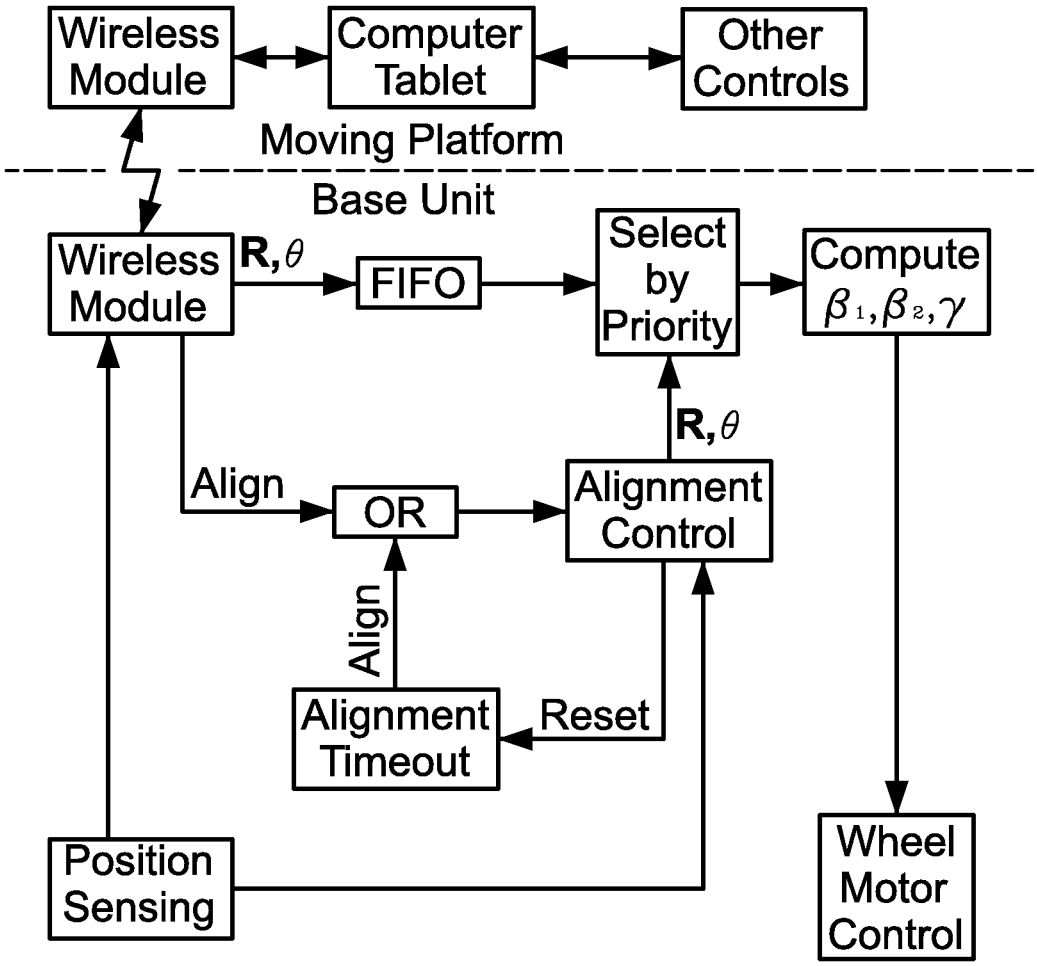
FIG. 6 is a block diagram showing a possible arrangement of the control system.

FIG. 6 shows a possible organization for control. The dashed line separates the part in the moving platform from that in the base unit. The part in the moving platform centers on the Computer Tablet, which communicates with Other Controls, preferably by wireless links. Control commands are communicated through the Wireless Module of the Computer Tablet to the Wireless Module in the electronics module of the base unit. The most common command is to rotate the sphere according to rotation vector R to a particular position, as indicated by the angle $\theta$. Consecutively arriving values of the pair <R, $\theta$> are pushed into the first-in, first-out register (FIFO). They are passed on at appropriate times.

FIG. 6 shows one other type of command, the Align command. The pitch and roll positions of the moving platform are estimated using accelerometers in the Computer Tablet or Other Controls. Yaw position is determined by integrating the rotation rate obtained from drive wheel rotation and direction. Each of these positions is subject to drift, integration errors, or changing of the position of the computer tablet, so it is necessary to realign the moving platform occasionally. The electronics module has an Alignment Timeout unit which issues an Align command at appropriate times. The OR element combines commands so that an Align command is issued to the Alignment Control unit if the command is received from either the Wireless Module or the Alignment Timeout element.

When the Alignment Control unit receives an Align command, it issues a Reset signal to the Alignment Timeout unit, thereby starting the time interval to the next timeout; then it begins issuing rotation pairs <R, $\theta$>. The Select by Priority unit passes the <R, $\theta$> pairs to the Compute $\beta_1$, $\beta_2$, $\gamma$ unit, with commands from Alignment Control having priority over those from FIFO. The values of $\beta_1$, $\beta_2$, and $\gamma$ are passed to the Wheel Motor Control, which generates signals to the motors of the drive-wheel assemblies.

The electronics module has a Position Sensing unit which supplies some information about the sphere position to the Alignment Unit and, through the wireless connection, to the Computer Tablet. In a preferred embodiment, a Position Sensor 31 on mount 32 (see FIG. 1A and FIG. 3) uses optical or magnetic means to determine sufficient information for homing (realigning) the moving platform. For example, an optical means might sense only a few optically contrasting marks on the sphere. One such mark is sufficient to establish a home position for yaw. A single optical sensor can be used for homing as follows: if yaw is moved to the home position first, a mark across the yaw mark is sufficient for homing pitch; roll can then be homed by using small movements of the sphere to test the orientation of the yaw mark. More complex optical patterns can be used if more complete position information is needed. The possibility of using more marks and/or optical sensors to obtain more complete position information will be apparent to persons familiar with the relevant art. The same applies for magnetic sensing, except that the marks are magnetic stripes.

The Computer Tablet generates commands for whatever motion simulation is being done. A single installation of this invention can be used for such activities as aircraft flight simulation, auto driving simulation, space trip simulation, etc. Each kind of simulation has a corresponding app. The exact nature of such apps is not a part of this invention, but persons familiar with the relevant art would be able to develop apps for particular applications.

Figure 1A:
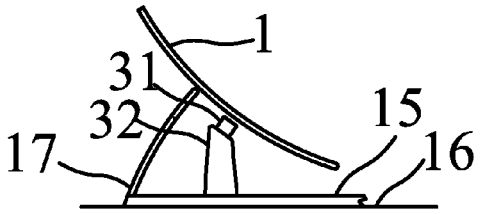
FIG. 1A shows the position sensor.
Figure 1B:
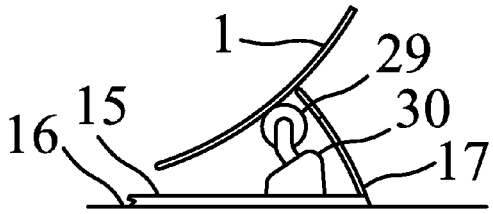
FIG. 1B shows the use of a caster instead of a ball.
Figure 2:
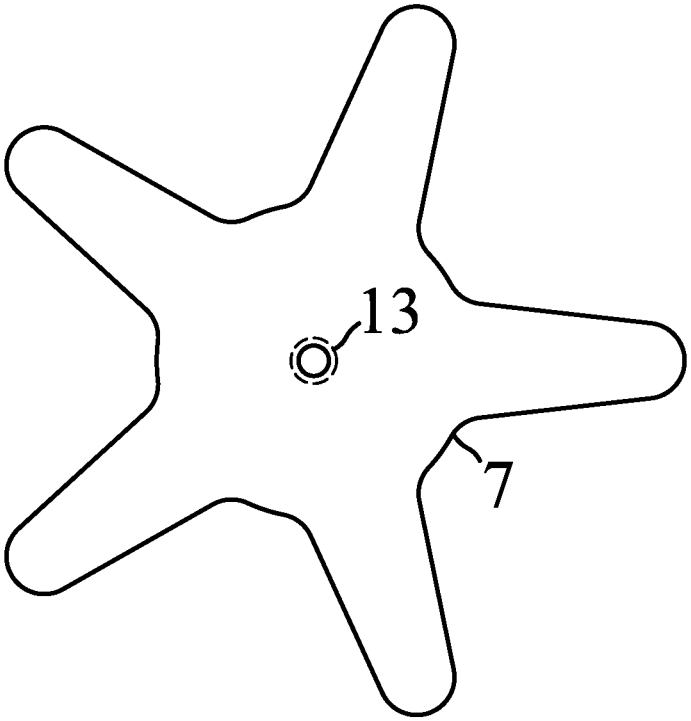
FIG. 2 is the retainer plate 7 as viewed from the top.

It will be apparent to persons familiar with the relevant art that a freely rotating ball can be replaced by a caster or a drive-wheel assembly. FIG. 1A shows an arrangement with caster 29 on caster mount 30 instead of freely rotating ball 8 on ball mount 9. If a drive-wheel assembly is used, the electronics module must coordinate rotation of all drive wheels.

Also, it will be apparent to persons familiar with the relevant art that a simulator can be constructed without a retainer plate 7. If that is done, the retainer plate mount 13 can be eliminated, and the clearance opening in the outer shell (represented by the opening's edge 18) can be closed. Moreover, the inner shell 4 and its support element 38 can be eliminated, and the seat mounting bracket 22 connected directly to outer shell 1. The disadvantage to this modified configuration is that there is nothing to prevent tipping of the moving platform. The advantages are that this is a less expensive configuration and it allows a greater range of pitch and roll motion.

The invention claimed is:

1. A motion simulator comprising
- a base unit with
  - a baseplate,
  - two drive-wheel assemblies rigidly mounted on the baseplate,
  - at least one freely rotating support ball mounted in a fixed position on the baseplate, and
  - an electronics module controlling the motions of the drive-wheel assemblies;
- a moving platform with
  - an exterior shell which is shaped as part of a sphere,
  - a seat for a human rider;
  - rider operated control units;
  - an interior shell which supports said seat and at least one human rider,
  - a shell closure element which connects the interior shell to the exterior shell and provides support for the interior shell and items supported by the interior shell,
- with the said exterior shell resting on the wheels of the two drive-wheel assemblies and the freely rotating ball or balls;
- with the wheels of the two drive-wheel assemblies frictionally rotating the moving platform;
- with the said drive-wheel assemblies positioned so there is a right angle between lines from the center of the sphere of the exterior shell to the centers of the contact points of the two drive-wheel assemblies with said sphere;
- with a retainer plate fitting between the exterior and interior shells of the moving platform, which retainer plate is rigidly supported by a mount rigidly fastened to the baseplate of the base unit, the mount passing through a hole in the exterior shell, said hole being large enough to allow useful pitch and roll motion of the moving platform;
- with the said electronics module in the base unit wirelessly connected to control units in the moving platform, said wireless connection capable of transferring information in both directions;
- with said control units in the moving platform including a computer tablet or smart phone;
- with said electronics module in the base unit receiving rotation descriptions from control units in the moving platform, and using these descriptions to control drive wheel motions to cause the moving platform to move correspondingly.

2. A motion simulator as in claim 1 with an optical sensor for determining a home position for aligning the system.

3. A motion simulator as in claim 1 with an magnetic sensor for determining a home position for aligning the system.

4. A motion simulator as in claim 1 with at least one freely-rotating ball and ball mount replaced by a drive-wheel assembly.

5. A motion simulator as in claim 1 with the freely rotating ball replaced with a freely rotating caster.

6. A motion simulator comprising
- a base unit with
  - a baseplate,
  - two drive-wheel assemblies rigidly mounted on the baseplate,
  - at least one freely rotating support ball mounted in a fixed position on the baseplate, and
  - an electronics module controlling the motions of the drive-wheel assemblies;
- a moving platform with
  - a shell which is shaped as part of a sphere,
  - a seat for a human rider;
  - rider operated control units;
- with the said shell resting on the wheels of the two drive-wheel assemblies and the freely rotating ball or balls;
- with the wheels of the two drive-wheel assemblies frictionally rotating the moving platform;
- with the said drive-wheel assemblies positioned so there is a right angle between lines from the center of the sphere of the shell to the centers of the contact points of the two drive-wheel assemblies with said sphere;
- with the said electronics module in the base unit wirelessly connected to control units in the moving platform, said wireless connection capable of transferring information in both directions;
- with said control units in the moving platform including a computer tablet or smart phone;
- with said electronics module in the base unit receiving rotation descriptions from control units in the moving platform, and using these descriptions to control drive wheel motions to cause the moving platform to move correspondingly.

7. A motion simulator as in claim 6 with an optical sensor for determining a home position for aligning the system.

8. A motion simulator as in claim 6 with an magnetic sensor for determining a home position for aligning the system.

9. A motion simulator as in claim 6 with at least one freely-rotating ball and ball mount replaced by a drive-wheel assembly.

10. A motion simulator as in claim 6 with the freely rotating ball replaced with a freely rotating caster.

* * * * *